US007152851B2

(12) United States Patent
Cincotta

(10) Patent No.: US 7,152,851 B2
(45) Date of Patent: Dec. 26, 2006

(54) STEAM INJECTION HEATER WITH DUAL-SEALING ASSEMBLY

(75) Inventor: Bruce A. Cincotta, Wauwatosa, WI (US)

(73) Assignee: Hydro-Thermal Corporation, Waukesha, WI (US)

( * ) Notice: Subject to any disclaimer, the term of this patent is extended or adjusted under 35 U.S.C. 154(b) by 161 days.

(21) Appl. No.: 11/051,769

(22) Filed: Feb. 4, 2005

(65) Prior Publication Data

US 2006/0175721 A1 Aug. 10, 2006

(51) Int. Cl.
*B01F 3/04* (2006.01)

(52) U.S. Cl. ..... 261/64.1; 261/77; 261/124; 261/DIG. 10

(58) Field of Classification Search ..... 261/62, 261/64.1, 76, 77, 78.2, 124, DIG. 10, DIG. 13, 261/DIG. 76, DIG. 78; 122/442; 239/417.3, 239/432; 366/178.2, 182.1
See application file for complete search history.

(56) References Cited

U.S. PATENT DOCUMENTS 2,913,232 A * 11/1959 Silverman ..... 261/40
4,732,712 A * 3/1988 Burnham et al. ..... 261/64.3
5,395,569 A * 3/1995 Badertscher et al. ..... 261/62
5,622,655 A 4/1997 Cincotta et al.
5,842,497 A 12/1998 Drifka et al.
6,082,712 A 7/2000 Cincotta et al.
6,186,481 B1 * 2/2001 Pirkle ..... 261/39.1
6,361,025 B1 3/2002 Cincotta et al.
6,955,340 B1 * 10/2005 Palm ..... 261/62
7,025,338 B1 * 4/2006 Cincotta et al. ..... 261/64.1

* cited by examiner

*Primary Examiner*—Scott Bushey
(74) *Attorney, Agent, or Firm*—Andrus, Sceales, Starke & Sawall, LLP

(57) ABSTRACT

A direct contact steam injection heater that includes a steam diffuser having a plurality of steam diffusion holes that are selectively exposed by a regulating member to control the amount of steam used to heat a liquid. The regulating member is movable within the steam diffuser and includes a seating member to prevent the flow of steam from the diffuser when the regulating member is in a completely closed, seated position. A pair of sealing members surround the discharge region of the steam diffuser when the regulating member is in the closed position. The diameter of the steam diffusion holes and the distance between the steam diffuser and the inner wall of the heater body is selected to maintain a desired ratio to reduce bubbles that cause noise and vibration within the direct contact steam injection heater.

20 Claims, 4 Drawing Sheets

STEAM INJECTION HEATER WITH DUAL-SEALING ASSEMBLY

BACKGROUND OF THE INVENTION

The present invention relates to direct contact steam injection heaters. More specifically, the present invention relates to an improvement for controlling the amount of steam flow into the liquid being heated while also providing a liquid tight seal during a completely closed condition.

In direct contact steam injection heaters, steam is directly mixed with a liquid being heated, or in some cases with a slurry being heated. Direct contact steam injection heaters are very effective at transferring heat energy from steam to the liquid. The injection heater provides rapid heat transfer with virtually no heat loss to atmosphere, and also transfers both the latent and the available sensible heat of the steam to the liquid.

The present invention was developed during ongoing development efforts by the assignee in the field of direct contact steam injection heaters. U.S. Pat. Nos. 5,622,655; 5,842,497; 6,082,712; and 6,361,025 all represent some of the prior art developments in direct contact steam injection heaters by the assignee, and are hereby incorporated by reference.

SUMMARY OF THE INVENTION

The present invention is a direct contact steam injection heater in which steam is injected through a plurality of relatively small steam diffusion holes in a steam diffuser into a liquid flowing through a combining region in a heater body. The combining region has an inlet for the liquid and an outlet for the heated liquid. The steam diffuser is generally coaxial with and resides within the combining region. Steam radially exits through the plurality of steam diffusion holes at a generally sonic velocity into the liquid flow. The small radial jets of steam into the axial flow of liquid within the combining region enhance mixing of the liquid and steam.

The steam diffuser includes a discharge region having the plurality of evenly spaced steam diffusion holes. A regulating member is positioned within the steam diffuser to regulate the amount of steam exiting the steam diffuser. Specifically, the regulating member exposes an increasing number of the steam diffusion holes to the flow of steam as the regulating member moves from a completely closed, seated position to a fully open position.

The regulating member includes a lower, seating member that contacts a sloping sealing wall formed as part of the steam diffuser. The interaction between the seating member and the sloped, sealing wall of the steam diffuser creates an end seal that prevents the flow of steam past the seating member when the regulating member is in its completely closed position. The regulating member also includes a first sealing member and a second sealing member that are positioned on opposite sides of the discharge region of the steam diffuser when the regulating member is in its completely closed, seated position.

As the regulating member moves away from the completely closed, seated position, the seating member moves out of contact with the sloped sealing wall of the steam diffuser. Once the seating member has moved, steam is allowed to flow between the regulating member and the outer wall of the steam diffuser, thereby allowing steam to reach the discharge region and ultimately be discharged through the plurality of steam diffusion holes. As the regulating member moves from the closed position, the first sealing member restricts the flow of steam to control the amount of steam reaching the discharge region when the regulating member is at its lower end of travel. As the regulating member continues to move closer to the fully open position, the first sealing member moves along the discharge region and exposes an increasing number of the plurality of steam diffusion holes to the flow of stream, thus increasing the amount of steam discharged from the diffuser.

The diameter of the steam diffusion holes and the distance between the outer wall of the steam diffuser and the outer wall of the heater body is selected to prevent the steam jet emitted from each hole from impinging on the outer wall of the heater body. Preferably, the distance from the discharge opening of the steam jet to the opposing wall of the heater body is selected to be at least eleven times the diameter of the steam diffusion holes. If the distance is less than eleven times the diameter of the steam diffusion holes, a portion of the steam jet will impinge on the outer wall of the heater body and steam momentum will be lost. The proper relationship between the distance between the steam diffuser and the heater body and the diameter of the steam diffusion holes reduces the amount of bubbles within the liquid being heated, thereby reducing the noise and vibration within the steam injection heater.

Other features and advantages of the invention will be apparent upon inspecting the drawings and the following description thereof.

BRIEF DESCRIPTION OF THE DRAWINGS

The drawings illustrate the best mode presently contemplated of carrying out the invention. In the drawings.

DETAILED DESCRIPTION OF THE PREFERRED EMBODIMENT

Figure 1:
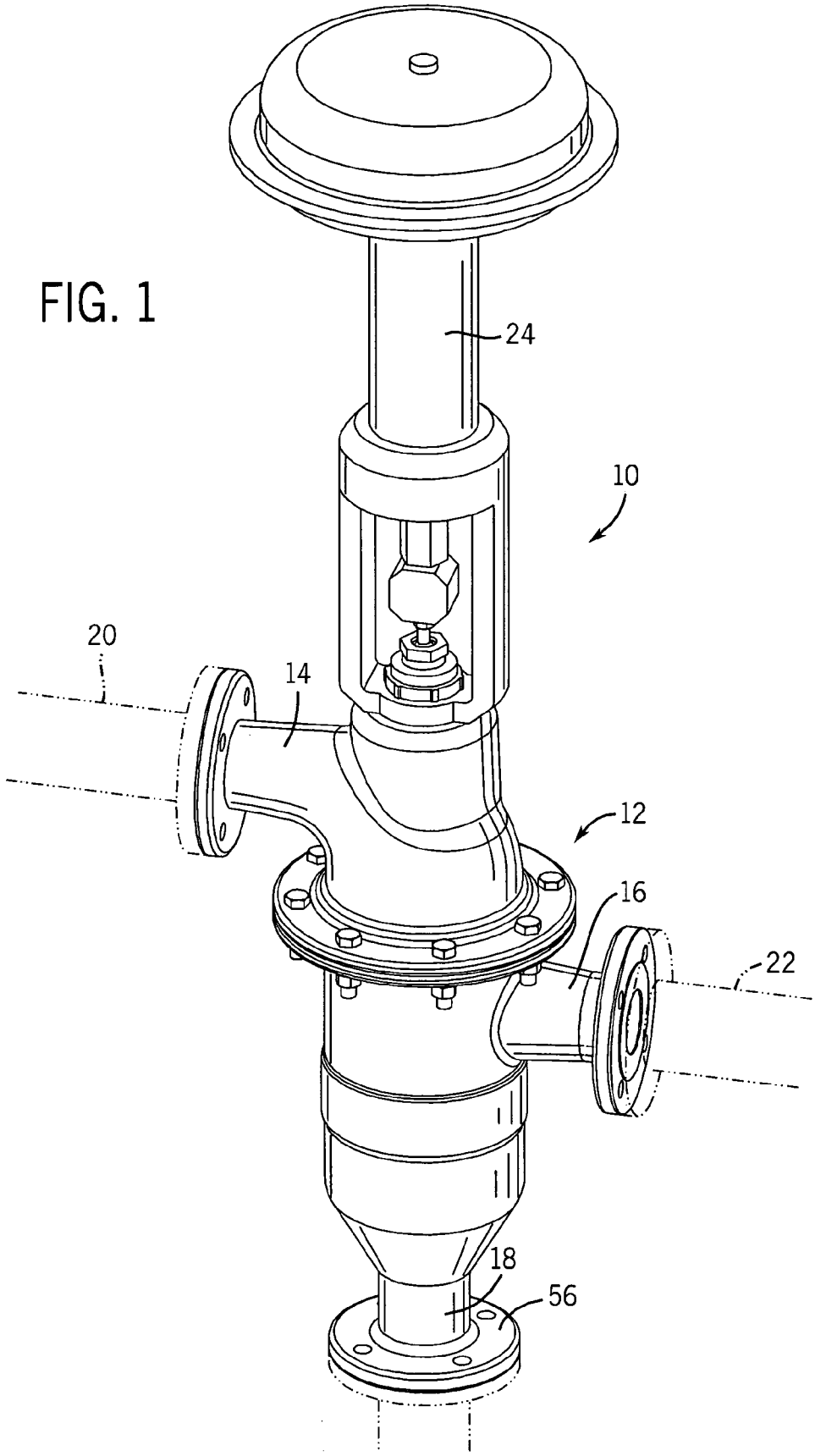
FIG. 1 is a perspective view of the direct contact steam injection heater of the present invention.

FIG. 1 generally shows a direct contact steam injection heater 10 constructed in accordance with the present invention. The injection heater 10 has a heater body 12 that includes a steam inlet 14, a liquid inlet 16 and a heated liquid product discharge outlet 18. Steam flows into the steam inlet 14 from a supply pipe 20. A liquid or slurry product to be heated enters the heater body 12 through an inlet pipe 22 that is coupled to the liquid inlet 16. As the liquid flows through the steam injection heater 10, a flow of steam is injected into the liquid flow such that the liquid flow is heated prior to exiting the heater body 12 at the heated liquid outlet 18.

As illustrated in FIG. 1, the steam injection heater 10 includes an actuator 24 that controls the amount of steam injected into the liquid flow in the manner to be described in greater detail below.

Figure 2:
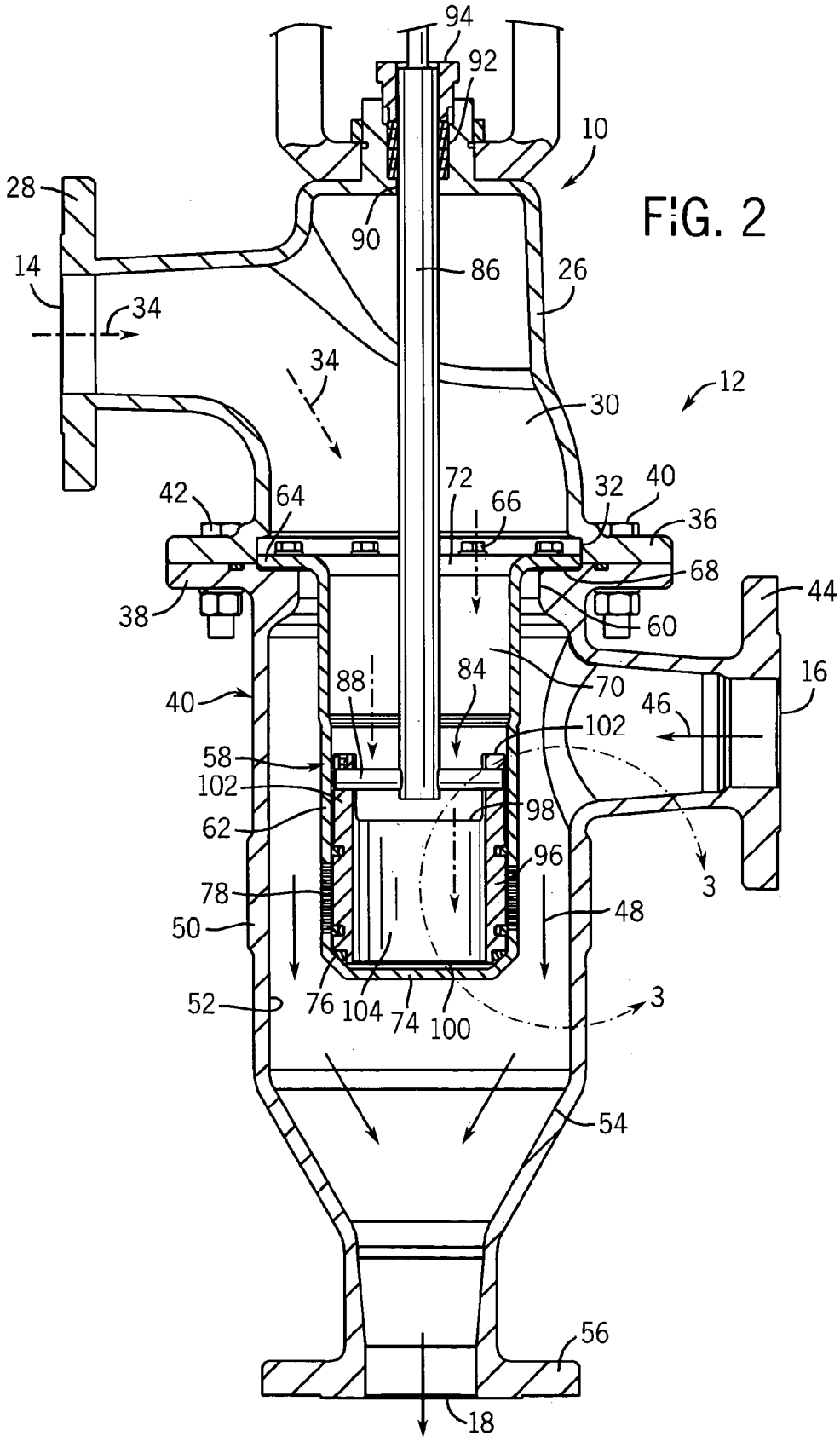
FIG. 2 is a cross section view of the direct contact steam injection heater of the present invention.

Referring now to FIG. 2, the steam inlet 14 is formed as a portion of a steam housing 26 and includes an outer flange 28 used to attach the steam housing 26 to the steam supply pipe. The steam housing 26 has a generally open interior 30 that defines a lower opening 32. As steam enters into the steam housing 26, the flow of steam is directed toward the lower opening 32, as illustrated by arrows 34.

The steam housing 26 includes an attachment flange 36 that is positioned in contact with a similar attachment flange 38 formed as part of the liquid housing 40. A series of connectors 42 are used to securely attach the steam housing 26 to the liquid housing 40 to define the heater body 12.

As illustrated in FIG. 2, the liquid housing 40 includes the liquid inlet 16, which is surrounded by flange 44 that facilitates attachment of the liquid inlet 16 to the supply pipe. The flow of liquid, as represented by arrow 46, is directed into a combining region 48 generally defined by the open interior of the liquid housing 40. The combining region 48 is generally an open interior of the heater body 12 that is positioned below the liquid inlet 16. In general, the combining region 48 is defined by the generally cylindrical outer wall 50 and has an internal diameter defined by the inner wall surface 52. The flow of liquid passes through the combining region 48 and reaches the inwardly sloping lower wall 54 that directs the flow of fluid toward the heater liquid outlet 18. The liquid outlet 18 is surrounded and defined by an attachment flange 56 used to attach the heater body 12 to a discharge pipe (not shown).

A steam diffuser 58 is mounted across the upper opening 60 of the liquid housing 40 in axial alignment with the lower opening 32 of the steam housing 26. The steam diffuser 58 includes an outer wall 62 extending from an upper attachment flange 64. The attachment flange 64 includes a plurality of connectors 66 to secure the steam diffuser 58 to an attachment surface 68 extending around the upper opening 60. The outer wall 62 of the steam diffuser 58 is generally cylindrical and defines an open interior 70. The open interior 70 extends from an open upper end 72 to an end wall 74. The end wall 74 is joined to the side wall 62 by an angular, annular sealing surface 76.

The steam diffuser 58 includes a discharge region 78 formed in the outer wall 62 slightly above the end wall 74. As can best be seen in FIG. 3, the discharge region 78 includes a plurality of steam diffusion holes 80 that each extend through the outer wall 62 to provide a flow passageway between the open interior 70 of the steam diffuser 58 and the combining region 48 such that steam can flow into the combining region 48 through the steam diffusion holes 80, as illustrated by arrows 82 in FIG. 4. Preferably, the steam diffusion holes 80 are equally distributed around the entire outer circumference of the generally cylindrical steam diffuser 58 such that steam can flow from within the steam diffuser into the flow of liquid around the entire outer circumference of the steam diffuser. The size and number of the steam diffusion holes 80 is a matter of design choice depending on the size of the heater; however, a diameter of about 1/16th of an inch is preferred in most applications. Such a diameter is sufficiently small to facilitate the creation of relatively small radial jets of steam through the diffuser outer wall 62, yet it is not so small as to create other problems such as scaling due to liquid characteristics. In addition, it is preferred that the steam diffuser 58 be made of stainless steel and that the outer wall 62 have a thickness sufficient to drive away premature deterioration as steam passes through the steam diffusion holes 80 over an extended period of time.

Figure 3:
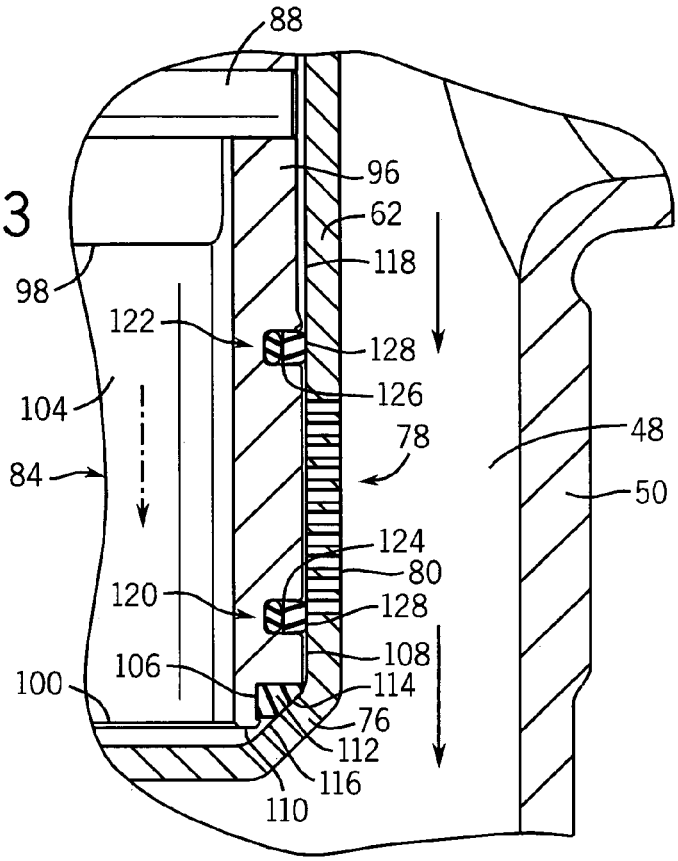
FIG. 3 is a magnified view taken along line 3—3 showing the interaction between the discharge region of the steam diffuser and the regulating member.

As illustrated in FIG. 3, the plurality of steam diffusion holes 80 are arranged at least in part longitudinally along the outer wall 62. As will be described below, the amount of steam supplied by the steam diffuser 58 into the liquid flowing through the combining region 48 can be modulated by moving a regulating member 84 to expose an increasing number of steam diffusion holes 80.

Referring back to FIG. 2, steam injection heater 10 includes a regulating member 84 removably positioned within the open interior 70 of the steam diffuser 58. The regulating member 84 is movable along the longitudinal axis of the steam diffuser 58 to selectively control the amount of steam flow through the steam diffusion holes 80 in the discharge region 78. The regulating member 84 is coupled to a actuation stem 86 by a retaining pin 88. The actuation stem 86 passes through a top opening 90 formed in the steam housing 26 and is coupled to the actuator 24 shown in FIG. 1. Packing material 92 surrounds the stem 86 and is held in place by a packing nut 94. The packing material 92 in combination with the packing nut 94 provide a seal around the actuator stem 86.

Referring back to FIG. 2, in a preferred embodiment of the invention, the regulating member 84 is a piston defined by a cylindrical outer wall 96. The cylindrical outer wall 96 defines an open top end 98 and an open bottom end 100. The outer wall 96 defines a pair of spaced yokes 102 that each receive an end of the retaining pin 88. As can be understood in FIG. 2, the flow of steam entering the steam diffuser 58 is allowed to flow into the regulating member 84 through the open top end 98, through the open interior 104 and out of the open bottom end 100.

Figure 4:
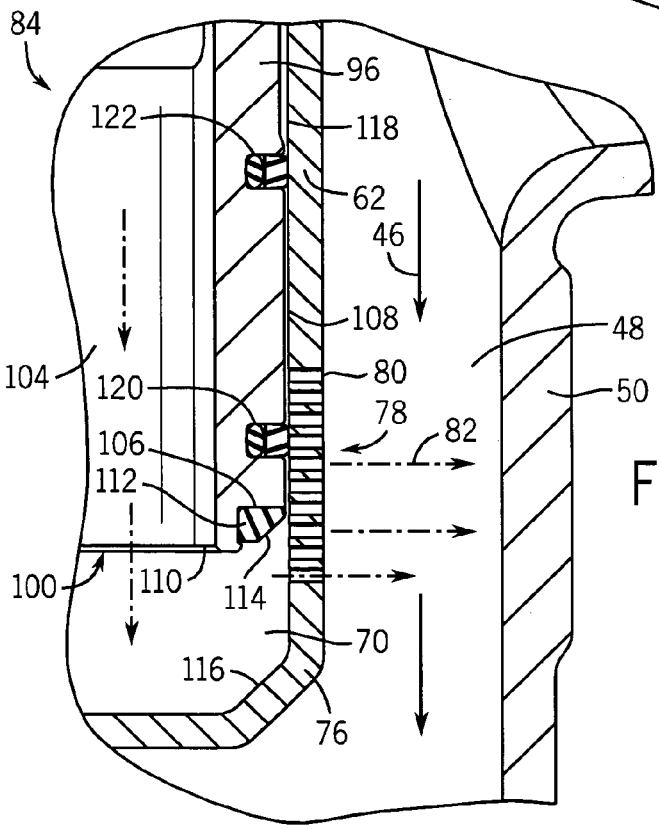
FIG. 4 is a view similar to FIG. 3 showing the movement of the regulating member from the closed position to a partially open position.

Referring now to FIGS. 3 and 4, the bottom end 100 of the regulating member 84 includes a receiving notch 106 recessed from both the circumferential outer surface 108 and the end wall 110. The receiving notch 106 receives a seating member 112. In the preferred embodiment of the invention, the seating member 112 is a resilient, angular member having a sloped contact surface 114 that engages the sloping inner surface 116 of the sealing wall 76. In the preferred embodiment of the invention, the seating member 112 is formed from a resilient, elastomeric material.

When the regulating member 84 is in its completely closed seating position as shown in FIG. 3, the seating member 112 creates a fluid tight end seal that prevents the steam within the open interior 104 from passing between the outer surface 108 of the regulating member 84 and the inner surface 118 of the outer wall 62. Thus, when the regulating member 84 is in its completely closed position, the seating member 112 prevents the flow of steam from reaching the steam diffusion holes 80 in the discharge region 78. As can be understood in FIG. 4, the sloped contact surface 114 of the seating member 112 is recessed radially inward from the outer surface 108 and thus does not contact the steam diffusion holes 80, which significantly reduces the wear to the seating member 112.

Referring back to FIG. 3, the regulating member 84 includes a first sealing member 120 and a second sealing member 122. The first sealing member is received within groove 124 recessed from the outer surface 108 and extends around the entire outer circumference of the regulating member 84. The second sealing member 122 is received within a similar groove 126. In the preferred embodiment of the invention, both the first sealing member 120 and the second sealing member 122 are resilient, annular rings that include a contact surface 128 that engages the inner surface 118 of the outer wall 62. In the preferred embodiment of the invention, both the first sealing member 120 and the second sealing member 122 are components known as Turcon Glyd rings available from Busak and Shamban. However, it is contemplated that different components can be utilized for the first and second sealing members 120,122 while operating within the scope of the present invention.

When the regulating member 84 is in its completely closed, seated position, the first sealing member 120 is positioned below the discharge region 78 while the second sealing member 122 is positioned above the discharge region 78. Thus, the entire discharge region 78 is contained between the first sealing member 120 and the second sealing member 122. As described previously, when the regulating member 84 is in its completely closed, seated position, the seating member 112 prevents the flow of steam to the discharge region 78. When the regulating member 84 is fully seated, the first sealing member 120 and the second sealing member 122 provide a controlling seal to prevent the liquid flowing within the combining region 48 from entering into the steam diffuser past the discharge region 78.

As the regulating member 84 is moved axially within the steam diffuser, as shown in FIG. 4, the seating member 112 is moved away from the sealing wall 76 such that steam is initially allowed to flow between the outer surface 108 of the regulating member 84 and the inner surface 118 of the outer wall 62. The first sealing member 120 functions as a controlling seal that allows controlled leakage of steam past the sealing member 120. Since the sealing member 120 is continuously moved along the series of steam diffusion holes 80 within the discharge region 78, the first sealing member 120 cannot be counted on to provide a liquid tight seal. Thus, the first sealing member 120 functions as a controlling member to allow a controlled leakage of steam to the discharge region 78.

Figure 5:
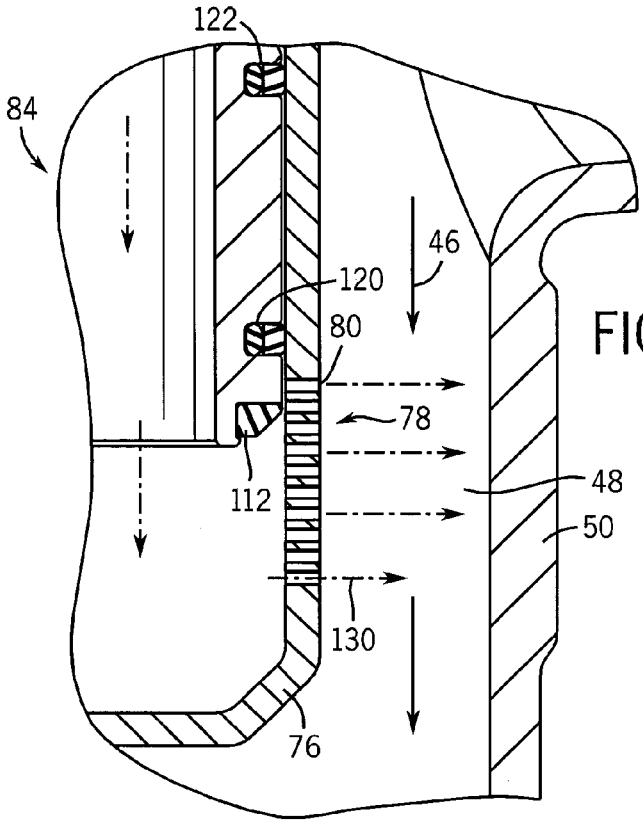
FIG. 5 is a view similar to FIG. 4 illustrating the regulating member in a completely open position.

As the regulating member 84 continues to move upward as shown in FIG. 5, the first sealing member 120 exposes an increasing number of the steam diffusion holes 80. When the regulating member 84 reaches a completely open position, the first sealing member 120 is positioned above the discharge region 78 to expose all of the steam diffusion holes 80 contained within the discharge region 78, thereby allowing the maximum amount of steam to reach the combining region 48. Each of the steam diffusion holes 80 creates a steam jet 130 that enters into the flow of liquid 46 to heat the liquid.

As described previously, the first sealing member 120 allows a controlled flow of steam once the seating member 112 breaks contact with the sealing wall 76. The first sealing member 120 prevents excessive leakage past the seal. The controlled leakage of steam past the first sealing member 120 is important such that the amount of steam exiting the steam diffuser can closely track the position of the regulating member in order to offer adequate steam control. If the amount of steam leakage past the first sealing member 120 is excessive, too much steam will flow out of the discharge region 78 and it may be impossible to control the temperature of the discharged liquid at the lower end of the regulating member travel.

Figure 6:
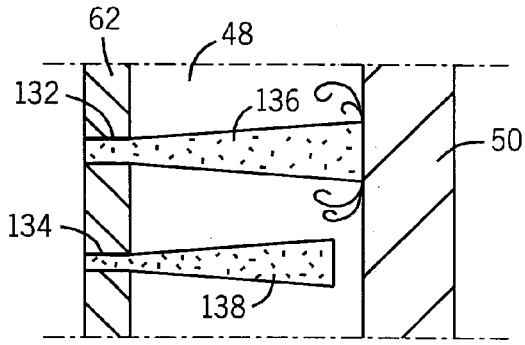
FIG. 6 is a magnified view showing the impingement of a steam jet relative to the diameter of the diffusion hole.

Referring now to FIG. 6, thereshown are two alternate configurations for the steam diffusion holes. In the first alternate configuration shown in FIG. 6, the steam diffusion hole 132 has an increased diameter as compared to the steam diffusion hole 134. The differences in the diameter between the two steam diffusion holes 132 and 134 results in the first steam jet 136 having a greater size and volume as compared to the second steam jet 138. As illustrated in FIG. 6, the first steam jet 136 contacts the outer wall 50 of the heater body, while the second steam jet 138 dissipates prior to contacting the outer wall 50.

The steam velocity has been found to be highest when the pressure in the mixing or combining region 48 is less than the critical pressure of the incoming steam. This pressure is generally 57.5% of the absolute steam pressure. In the embodiment of the invention illustrated in FIG. 6, the steam velocity exiting in each of the jets 136,138 is essentially sonic and about 1,450 ft/sec. At discharge pressures higher than the critical pressure for the steam, the steam jet velocity is less and the jet length is shorter. The high velocity of steam is critical to the condensation effect but also can create a problem if the steam jet is not allowed to dissipate completely.

Figure 7:
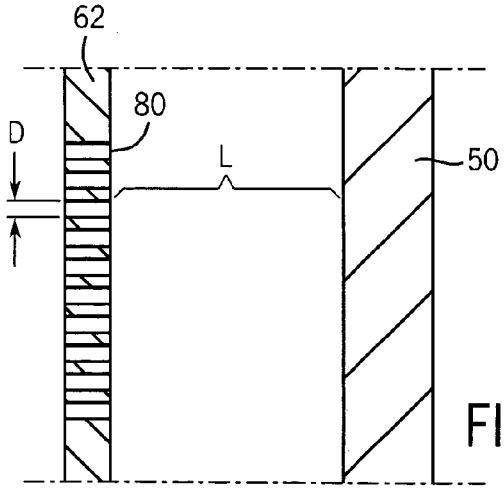
FIG. 7 is a schematic illustration showing the preferred ratio between the diameter of the steam diffusion holes and the distance to the heater body sidewall.

After leaving the steam diffusion hole, the mass of steam in the jet quickly dissipates and the momentum of the jet falls off proportionately. For stable, predictable operation, the heater needs to be designed so that the steam jet is mostly condensed before the steam jet reaches the outer wall 50. The steam jet behavior is predictable through a known medium, such as water. With stable steam velocity, the variables that can be altered are the diameter D of the steam diffusion holes and the distance L from the exit point of the steam to the opposing outer wall 50, as best shown in FIG. 7.

In accordance with the present invention, it has been determined that the optimal distance L from the steam diffusion holes 80 to the opposing outer wall 50 is at least eleven times the diameter D of the steam diffusion holes. If the distance L is less than eleven times the diameter D, a significant portion of the steam jet will impinge on the opposing wall 50 and the steam momentum will be lost. When this occurs, the steam forms overly large bubbles in the liquid being heated. These bubbles will cause noise and vibration when they eventually collapse and condense in the liquid. In the preferred embodiment of the invention, the steam diffusion holes have a diameter of approximately $1/16^{th}$ of an inch and the distance L to the wall 50 is at least $11/16^{th}$ of an inch. However, different hole diameters D and distances L could be utilized while operating within the scope of the present invention, as long as the distance L is at least eleven time the diffusion holes diameter D.

With the invention as described in FIGS. 2–7, steam bubbles within the combining region 48 remain relatively small and therefore steam condensation within the combining region 48 does not cause substantial vibrations, even when heating difficult liquids (e.g. liquids having relatively small numbers of nucleation points, or liquids having insufficient surface tension).

While the preferred embodiment of the invention has been shown in connection with FIGS. 1–7, it should be noted that the invention is not limited to this specific embodiment. For example, while the drawings show a regulating member having a generally piston-like shape, it is contemplated that the regulating member could have different shapes and be movable in different manners to selectively expose a number of the steam diffusion holes 80 within the discharge region 78.

What is claimed is:

1. A direct contact steam injection heater comprising:

a heater body having a steam inlet, a liquid inlet, a combining region and a heated liquid outlet;

a steam diffuser positioned at the steam inlet to receive a flow of steam, the steam diffuser extending into the combining region of the heater body, the steam diffuser having a generally cylindrical outer wall joined to an end wall;

a discharge region formed on a portion of the steam diffuser, the discharge region including a plurality of steam diffusion holes through which steam is discharged from the steam diffuser into the combining region of the heater body;

a regulating member movably positioned within the steam diffuser to control the discharge of steam from the discharge region, the regulating member having an open interior defined by a cylindrical outer wall extending between an open top end and an open bottom end, wherein the open interior of the regulating member receives the flow of steam;

a seating member positioned near the bottom end of the regulating member, wherein the seating member creates an end seal to prevent the flow of steam to the discharge region when the regulating member is in a completely closed position; and a first sealing member and a second sealing member extending around an outer surface of the regulating member, each of the first and second sealing members being in contact with the outer wall of the steam diffuser, wherein the discharge region is positioned between the first sealing member and the second sealing member when the regulating member is in the completely closed position.

2. The injection heater of claim 1 wherein the regulating member is movable from the completely closed position to an open position, wherein the first sealing member restricts the flow of steam between the outer surface of the regulating member and the outer wall of the steam diffuser.

3. The injection heater of claim 2 wherein the first sealing member is positioned such that an increasing area of the discharge region is exposed to the flow of steam as the regulating member moves from the closed position to the open position.

4. The injection heater of claim 1 wherein the steam diffuser includes an angled sealing surface extending between the generally cylindrical outer wall and the end wall, wherein the seating member contacts the angled sealing surface to create the end seal when the regulating member is in the closed position.

5. The injection heater of claim 4 wherein the seating member is recessed from the outer surface of the regulating member such that the seating member is out of contact with the discharge region as the seating member moves along the discharge region.

6. The injection heater of claim 1 wherein the first sealing member and the second sealing member are each received within the annular recess formed in the outer surface of the regulating member.

7. The injection heater of claim 6 wherein each of the first and second sealing members are positioned to surround the discharge region when the regulating member is in the closed position to prevent the flow of the liquid into the steam diffuser upon removal of the flow of steam.

8. The injection heater of claim 1 wherein the heater body includes a cylindrical outer wall defining the combining region, wherein the outer wall of the steam diffuser is spaced from the outer wall of the heater body by a distance, wherein the distance between the outer wall of the steam diffuser and the outer wall of the heater body is at least eleven times a diameter of the steam diffusion holes.

9. The injection heater of claim 1 wherein the regulating member is a piston positioned to receive the flow of steam at the open top end and discharge the flow of steam through the open bottom end, wherein the first sealing member is positioned around an outer circumference of the piston, wherein the first sealing member exposes an increasing number of steam diffusion holes in the discharge region to the flow of steam as the piston moves from the closed position to the open position.

10. The injection heater of claim 1 wherein the plurality of steam diffusion holes are evenly distributed along the discharge region such that the movement of the regulating member from the closed position to the open position selectively exposes a constantly increasing number of steam diffusion holes.

11. A direct contact steam injection heater comprising:

a heater body having a steam inlet, a liquid inlet, a combining region and a heated liquid outlet;

a steam diffuser positioned at the steam inlet to receive a flow of steam, the steam diffuser extending into the combining region of the heater body, the steam diffuser having a generally cylindrical outer wall joined to an end wall;

a discharge region formed on a portion of the steam diffuser, the discharge region including a plurality of steam diffusion holes through which steam is discharged from the steam diffuser into the combining region of the heater body;

a regulating member movably positioned within the steam diffuser, the regulating member having an open top end to receive the flow of steam and an open bottom end to direct the flow of steam into the steam diffuser;

a first sealing member and a second sealing member each extending around an outer surface of the regulating member and in contact with an inner surface of the outer wall of the steam diffuser, wherein the discharge region is positioned between the first sealing member and the second sealing member when the regulating member is in a closed position, and wherein the first sealing member moves along the discharge region when the regulating member is moved from the closed position to an open position to selectively expose an increasing number of steam diffuser holes.

12. The injection heater of claim 11 wherein the first sealing member and the second sealing member are positioned on opposite sides of the discharge region when the regulating member is in the closed position, wherein the first sealing member and the second sealing member restrict the flow of liquid to be heated into the steam diffuser when the flow of steam is removed.

13. The injection heater of claim 11 further comprising a seating member positioned near the bottom end of the regulating member, wherein the seating member creates an end seal to prevent the flow of steam to the discharge region when the regulating member is in the closed position.

14. The injection heater of claim 13 wherein the steam diffuser includes an angled sealing surface extending between the generally cylindrical outer wall and the end wall, wherein the seating member contacts the angled sealing surface to create an end seal when the regulating member is in the closed position.

15. The injection heater of claim 14 wherein the seating member is recessed from the outer surface of the regulating member such that the seating member is out of contact with the discharge region as the seating member moves along the discharge region.

16. The injection heater of claim 11 wherein the heater body includes a cylindrical outer wall defining the combining region, wherein the outer wall of the steam diffuser is spaced from the outer wall of the heater body by a distance, wherein the distance between the outer wall of the steam diffuser and the outer wall of the heater body is at least eleven times a diameter of the steam diffusion holes.

17. A direct contact steam injection heater comprising:

a heater body having a steam inlet, a liquid inlet, a heated liquid outlet and a combining region defined by a cylindrical outer wall;

a steam diffuser positioned at the steam inlet to receive a flow of steam, the steam diffuser extending into the combining region of the heater body, the steam diffuser having a generally cylindrical outer wall joined to an end wall, wherein the outer wall of the steam diffuser is spaced from the outer wall of the heater body by a selected distance;

a discharge region formed on a portion of the steam diffuser, the discharge region including a plurality of steam diffusion holes each having a diameter, wherein steam is discharged from the steam diffuser into the combining region of the heater body through the plurality of steam diffusion holes;

a regulating member movably positioned within the steam diffuser to control the discharge of steam from the discharge region, the regulating member having an open interior that receives the flow of steam;

a seating member positioned on the regulating member, wherein the seating member creates an end seal to prevent the flow of steam from the regulating member to the discharge region when the regulating member is in a completely closed position; and a first seal member and a second seal member extending around an outer surface of the regulating member, each of the first and second sealing members being in contact with an inner surface of the outer wall of the steam diffuser, wherein the discharge region is positioned between the first sealing member and the second sealing member when the regulating member is in the closed position, wherein the distance between the outer wall of the steam diffuser and the outer wall of the heater body is at least eleven times the diameter of the steam diffusion holes.

18. The injection heater of claim 17 wherein each of the first and second sealing members are positioned to surround the discharge region when the regulating member is in the closed position to prevent the flow of liquid into the steam diffuser upon removal of the flow of steam.

19. The injection heater of claim 17 wherein the seating member is recessed from the outer surface of the regulating member such that the seating member is out of contact with the discharge region as the seating member moves along the discharge region.

20. The injection heater of claim 17 wherein the first sealing member is positioned such that an increasing area of the discharge region is exposed to the flow of steam as the regulating member moves from the closed position to an open position.

* * * * *